United States Patent [19]

Russell

[11] Patent Number: 4,824,117

[45] Date of Patent: Apr. 25, 1989

[54] BOARD GAME

[76] Inventor: John Russell, Martin Rd., LaGrangeville, N.Y. 12540

[21] Appl. No.: 144,485

[22] Filed: Jan. 15, 1988

[51] Int. Cl.[4] ..... A63F 3/00

[52] U.S. Cl. ..... 273/248

[58] Field of Search ..... 273/276, 248, 249, 243, 273/256

[56] References Cited

U.S. PATENT DOCUMENTS

| | | | |
|---|---|---|---|
| 1,591,576 | 7/1926 | Terppe | 273/248 |
| 2,666,644 | 1/1954 | Strehlow et al. | 273/256 |
| 3,817,531 | 6/1974 | King et al. | 273/276 |

FOREIGN PATENT DOCUMENTS

| | | | |
|---|---|---|---|
| 2116438 | 9/1983 | United Kingdom | 273/256 |

*Primary Examiner*—Edward M. Coven
*Assistant Examiner*—Benjamin Layno
*Attorney, Agent, or Firm*—Kenyon & Kenyon

[57] ABSTRACT

A board game is provided in which one object is to acquire animal body parts. The game employs a game board, tokens and a set of "Hospital Cards" which designate various animal parts. A round of the game ends once a player completes an animal and has successfully moved his token to its corresponding "Home" space on the game board. After playing four rounds a "Winner Card" is picked which establishes the criteria for determining the winner.

10 Claims, 2 Drawing Sheets

BOARD GAME

This invention relates to a board game. More particularly, this invention relates to a board game which provides for a winner based on a random selection of winning combinations.

As is known various types of games have been devised for enjoyment purposes. In some cases, the games involve moving tokens from one point to another over a path of blocks depicted on a board. Movement may be controlled by chance, for example, by rolling dice or using spinners. Movement may also be controlled by other variables such as directions which become effective upon a token reaching a certain block.

In such games, typical objectives are to accumulate money or property and the like. However, in such cases the game winner is usually established in accordance with a single set of rules which is known by the players prior to the game's commencement. For example, it may be that the player which accumulates the most money or property is declared the winner. Typically, the rules which determine the winner do not vary.

Accordingly, it is an object of the invention to provide a board game in which the winner is established in accordance with rules which are only established at a late stage in the game.

It is another object of the invention to provide a board game in which one of a plurality of potential rules establish the criteria for selecting the game winner.

It is another object of the invention to provide board game in which many different strategies may prevail.

It is another object of the invention to provide a board game in which the object of the game is to accumulate parts of an animal.

Briefly, the invention provide a board game based upon the collection of animal body parts, for example, for a cat. The game comprises a board having at least one path, including a plurality of spaces bearing instructions thereon, a plurality of tokens each of which has a representation of an animal thereon distinct from the remaining tokens, an indicator for controlling movement of a selected token in the path and various cards containing indicia for employing the game.

The cards include a plurality of sets of "Hospital" designated cards, a plurality of score cards and a set of "Winner" cards. Each set of "Hospital" cards corresponds to a respective token and includes individual cards containing indicia of at least one selected part of an animal represented on the respective token.

Each score card corresponds to a respective token and has indicia of selected parts of an animal represented on the token as well as indicia of a numerical value corresponding to each part.

Each "Winner" card contains a different instruction from the others of the set for determining a game winner.

The Hospital cards are correlated with the instructions on the board so that when a token moves onto a space, the instructions of that space indicate whether one or more of the Hospital cards may be taken from the set corresponding to the token. Each score card provides a means of determining the body parts obtained during a round of play while each "Winner" card provides instructions for a determination of the winner of the game, which in this case consists of more than one round of play.

The game may be played in a series of rounds, for example four. In this case, each score card can be provided with indicia indicating the body parts acquired during each round of play. A total score for a completed game can also be determined directly on the score card at the end of a game. Depending on the score, one of the players can be designated to draw the Winner card to determine the manner of selecting the winner of the game.

During play, a player becomes entitled to draw a card when his game token is moved onto a space of a game board which directs the player to draw one or more Hospital cards. Body parts may also be obtained in accordance with directives specified on spaces of the game board which take effect when a player's token is moved onto one of those spaces. The movement of game tokens is controlled by an indicator, e.g., a die.

Each body part is assigned a corresponding point value and the accumulation of body parts is registered on a score card. When a player completes an animal by collecting all of the animal's parts that player has the right to move his token to a space on the game board which corresponds to the player's home. Once a player reaches the home space, the first round is over. Additional rounds may be played and at the conclusion of the final round all of the scores are tallied. The person with the highest score then draws a card from the Winner cards for determining the game winner i.e., the player with the highest point score, the player with the most complete animals, the player with the most three legged animals, and the like.

Other objects and advantages of the invention will become more apparent from the following detailed description taken in conjunction with the accompanying drawings wherein.

Figure 1:
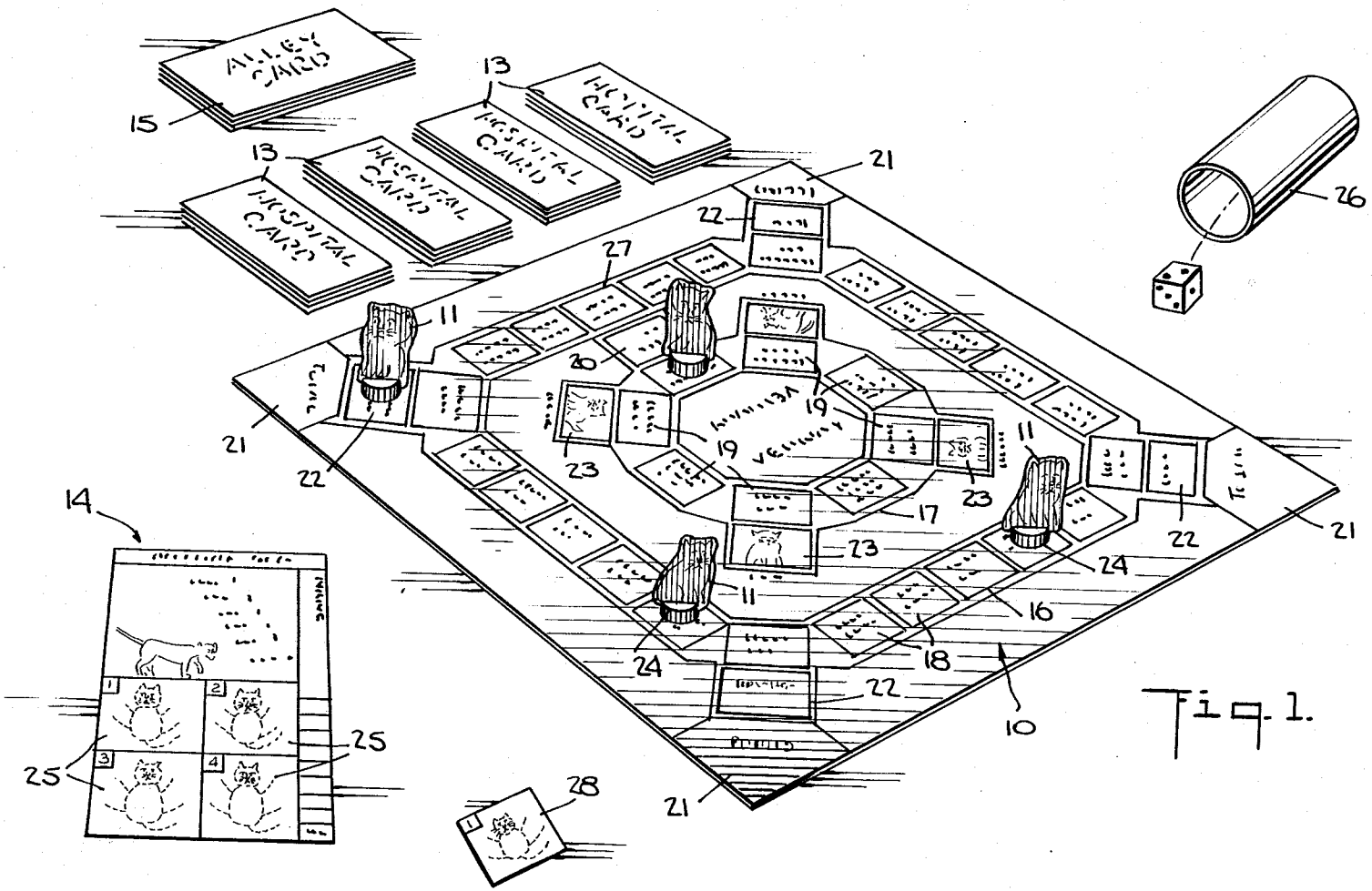
FIG. 1 illustrates the components of a board game according to the invention.

Referring to FIG. 1, the board game is shown including a board 10, a set of tokens 11, for example four tokens, an indicator 12, a plurality of sets of Hospital designated cards 13, a plurality of score cards 14 (only one of which is shown) and a set of Winner cards 15.

The board 10 is provided with two endless paths 16, 17, each of which is divided into a plurality of spaces 18, 19 with the inner path designated "veterinary hospital". In addition, the two paths 16, 17 are connected to each other via a single connecting space 20.

Figure 2:
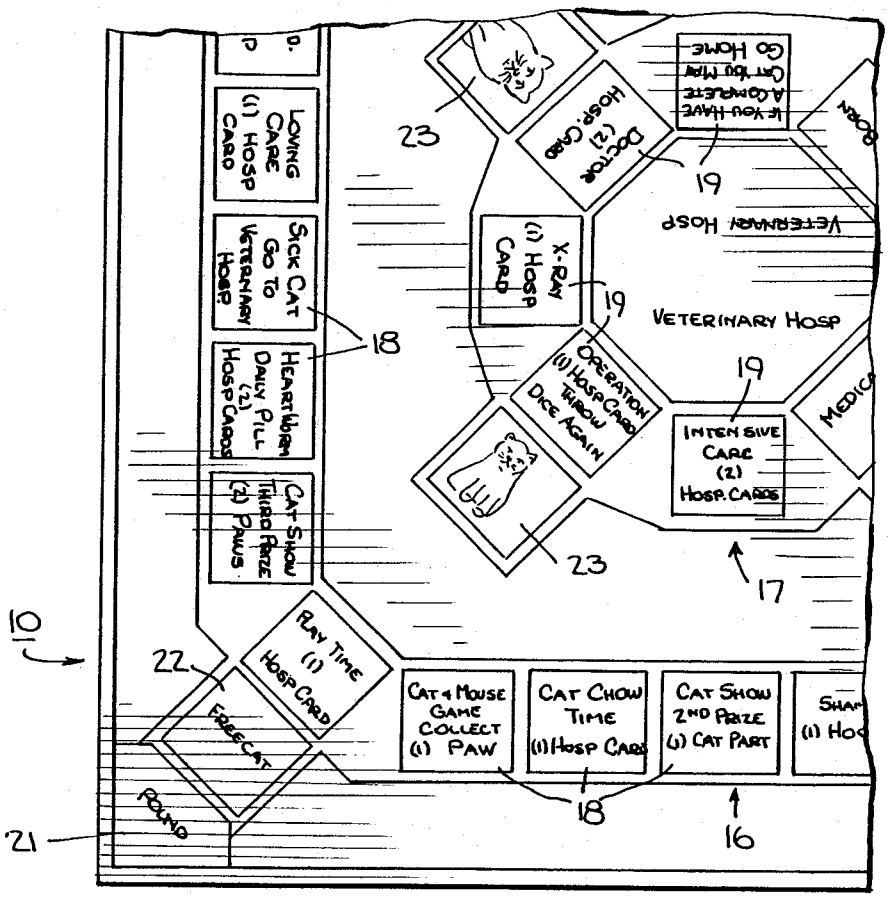
FIG. 2 illustrates a fragmentary view of the game board.

As indicated in FIG. 2, each space 18 or 19 on the board 10 depicts an instruction relative to the subject animal of the game i.e. a cat. Examples of instructions are:

OUTER PATH 16

1. Cat Fight/Move Four Spaces
2. Pregnant Cat/Collect One Hospital Card
3. Garbage Can Food Poisoning/Rush To Veterinary Hospital
4. Litter Box Time/Lose Turn
5. Sweet Dreams/Collect Two Hospital Cards
6. Cat Show First Prize/Choice Of Two Cat Parts
7. Rabies Shot/Collect Two Hospital Cards
8. Late For Kitty Cat Chow/Lose Turn
9. Warden/Go To Pound
10. Scratching Post/Collect One Hospital Card
11. Dog Chase/Move Three Spaces 12. Help/Collect Two Free Paws
13. Cat Nap Sleep Sweet Cat/Lose Turn
14. Loving Care/Collect One Hospital Card
15. Sick Cat/Go To Veterinary Hospital
16. Heart Worm Daily Pill/Collect Two Hospital Cards
17. Cat Show Third Prize/Collect Two Paws
18. Play Time/Collect One Hospital Card
19. Cat And Mouse Game/Collect One Paw And One Tail
20. Kitty Cat Chow Time/Collect One Hospital Card
21. Cat Show Second Prize/Choice Of One Cat Part
22. Shampoo Time/Collect One Hospital Card
23 Flea Time/Scratch A While
24. Sore Paw/Go To Help

INNER PATH 17 (VETERINARY HOSPITAL)

1. Doctor/Collect Two Hospital Cards
2. X-Ray/Collect One Hospital Card
3. Operation/Collect One Hospital Card Throw Dice Again
4. Intensive Care/Collect Two Hospital Cards
5. Medication Time/Collect Two Hospital Cards
6. Nurse/Collect One Hospital Card
7. Kittens Born Good Luck/Collect One Hospital Card
8. If You Have A Complete Cat You May Go Home It should be appreciated that numerous variations of these instructions can be used. It is preferred that the spaces 19 of the inner path 17 generally depict more rewarding directions than the spaces 18 of the outer path 16.

A plurality of starting spaces 21, preferably designated pound spaces, are located at various points on board 10. The number of pound spaces 21 corresponds to the maximum number of players which can participate in the game. If the shape of board 10 is square or rectangular, the pound spaces 21 are preferably located at each corner thereof. If the shape of board 10 is circular, the pound spaces 21 are preferably equidistant from each other.

The pound spaces 21 may be connected to outer path 16 by means of free cat spaces 22. Alternatively, each pound space 21 may directly abut a corresponding number of spaces 18 of outer path 16. The pound spaces may also be directly in the path of outer path 16.

A plurality of home spaces 23 exist on board 10. For example each home space 23 abuts a space 19 of the inner path 17. Each home space 23 corresponds to a particular pound space 21. Preferably, the home spaces 23 are arranged along the periphery of the inner path 17 so that the home spaces 23 are equidistant from each other.

Board 10 may also be provided with a plurality of "Warden/Go to Pound" designated spaces 27. The significance of this space is explained hereinafter.

Each token 11 has an upright representation of an animal, in this case a cat, which is distinct from the remaining tokens. Preferably, the pictorial representations stand upright on a flat base 24. Each token 11 is associated with a home space 23 and pound space 21.

Each game token 11 is also associated with a corresponding set of "Hospital" designated Cards 13. Each Hospital Card 13 bears indicia of at least one selected part of the animal represented on the corresponding token 11 on one side of the card. For example, a set of Hospital Cards 13 may include cards representing the following parts: one eye (two cards); one head (one card); one body (one card); one tail (one card); one leg (four cards); two ears (one card); and one ear (two cards). Variations of the foregoing representations and number of cards may exist. It is preferred that each set of Hospital Cards 13 be identical with respect to the number of cards representing each animal part.

Figure 3:
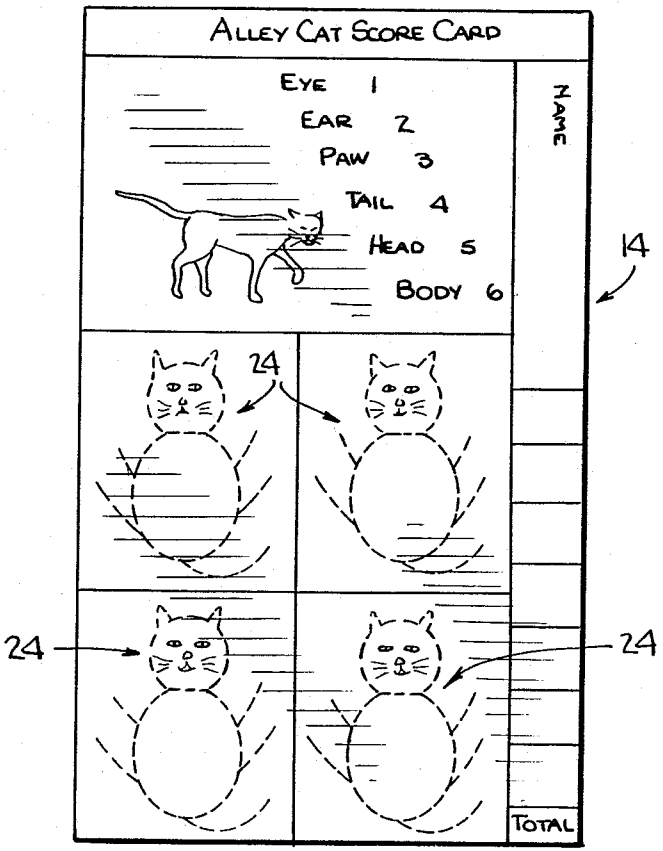
FIG. 3 illustrates a view of a score card.

Referring to FIG. 3 each score card 14 indicates a point value corresponding to each animal part. For example, point values may be assigned as follows:

1. eye—1 point
2. ear—2 points
leg or paw—3 points
4. tail—4 points
5. head—5 points
6. body—6 points As explained hereinafter, the point value for the animal part(s) indicated on the Hospital Card(s) 13 picked by each player during the course of the game should be registered on the player's score card 14. The score card 14 also depicts a plurality of fragmented animals 25, in this case, cats. The players should draw over the part(s) of the fragmented animal 25 which are indicated on the Hospital Cards picked during the course of the game in order to keep track of the parts which they need to complete an animal.

A plurality of stickers 28 depicting fragmented animals 28 are also provided. These stickers 28 are designed to be affixed on the score card 14 over a fragmented animal 25, which has been at least partially drawn on during the course f a game, in situations where the game rules dictate that the player must begin his game over. These rules are explained hereinafter. Preferably, each sticker 28 is a piece of paper depicting a fragmented animal, which can be easily glued or stapled onto the score card 14 and subsequently released.

Each Winner Card 15 bears an instruction on one side for determining the winner. A Winner Card is selected from a pre-shuffled set of Winner Cards which are face down so that the players cannot see the instructions. Examples of Winner Card instructions in the case of a cat are:

1. The player with the most two eye cats wins the game. (one card)
2. The player with the most one eye cats wins the game. (one card)
3. The player with the most three legged cats wins the game. (one card)
4. The player with the highest score wins the game (two cards)
5. The player with the most complete cats wins the game. (three cards)
6. The player with the most two eared cats wins the game. (one card)
7. The player with the most two legged cats wins the game. (one card)

Other instructions may be employed on the Winner cards 15 without departing from the invention. The number of Winner cards 15 bearing a certain instruction may also be varied.

At the commencement of the board game, each player selects a token 11 and places it on the corresponding pound space 21. An indicator 12, which is in the form of a die, is provided to control the movement of the game tokens 11 on board 10. A cup 25 may also be provided to facilitate rolls of the die 12. Each player rolls the die 12 and the player with the highest roll begins the game.

Play is commenced by rolling the die 12 and advancing the roller's token 11 from the pound space 21, a number of spaces equal to the number rolled. A token 11 may only be moved in accordance with the roll of the die 12 unless the space 18,19 onto which a game token is moved directs an additional movement. All players must advance their game tokens in one direction. Players do not have the option of moving clockwise on one turn and counter-clockwise on the next turn. Other restrictions oh movement of the tokens 11 are that they may not be moved into the connecting space 20 nor any of the spaces 19 of the inner path 17 until certain conditions are met as described hereinafter.

When a player moves his game token 11 onto a space the player must follow that space's instruction. If a player's game token is moved onto a space which directs the player to collect one or more Hospital Cards 13 the player must pick cards from the top of the set which corresponds to his token. Each set of cards should be placed with the sides depicting animal parts face down so that those sides cannot be seen before cards are picked. The player should then register the animal part(s) indicated on the Hospital Card(s) selected on the player's score card 14. Once a player registers his point score and draws over the fragmented animal 25 on the score card 14 he must return the Hospital Card(s) to the bottom of the set of cards corresponding to his token and pass the die to the next player in turn.

If at any time during the course of a round a player's token is moved onto a "Warden/Go to Pound" space 27 that player must move his token to its corresponding pound space 21. In addition, that player forfeits all animal parts and points which he has accumulated for that round. It is in this situation that the player affixes a sticker 28 on the score card 14 over the fragmented animal 25 which the player has drawn over during that round so that he can begin the round over again.

A player is not permitted to advance a game token to the connecting space 20 or onto the inner path 17

27 until one of the following events occur: (1) the player has accumulated sufficient animal parts to constitute a complete animal (i.e., the player has completely drawn over the fragmented animal 25 on score card 14); or (2) the player's game token has been moved onto a space of the outer path 16 which directs that the game token be moved onto the connecting space 20 or spaces 19 of the inner path 17. A player may move his token onto the home space 23 which corresponds to his token only upon completing a cat. Once a player successfully advances his game token onto its corresponding home space 23 the first round is over.

After the first round is concluded, a plurality of additional rounds may be played in the same fashion. Preferably, a total of four rounds are played. Each round is separate; a player may not complete an animal which he failed to complete in a previous round. The winner of the game can only be determined upon completion of the final round. After all rounds have been completed, each player must add all of his points. The player with the highest point total selects one of a plurality of Winner Cards 15 which establish the criteria for selecting the winner.

It should now be appreciated that the game promotes a variety of different strategies because the winner of the game is selected according to criteria which are not established until the end of the last round. For example, suppose there are two players and after the third round one player has three complete cats and the other player does not have an complete cats. Suppose further that during the fourth round the player without any complete cats acquires a complete cat before the other player. Because the winner of the game is not necessarily the player with the most complete cats, the player who is behind on complete cats during the fourth round may elect to refrain from an opportunity to move his game token into its home space in order to accumulate more points before the final round is concluded.

The game board 10 may be embellished with various attractive illustrations, colors, and the like. Further, the name of the game may be illustrated in the center of the board 10.

What is claimed is:

1. A board game comprising:

a board having at least one path including a plurality of spaces bearing instructions thereon;

a plurality of tokens, each said token having a representation of an animal therein distinct from the remaining tokens;

a plurality of sets of "Hospital" designated cards, each set corresponding to a respective token and including individual cards containing indicia of at least one selected part of an animal represented on said respective token;

a plurality of score cards, each card corresponding to a respective token and having indicia of selected parts of an animal represented on said respective token and indicia of a numerical value corresponding to each part;

an indicator for controlling movement of a selected token in said path on said board; and a set of "Winner" cards including at least two cards containing a different instruction from the other for determining a game winner.

2. A board game as set forth in claim 1 wherein said board includes a plurality of "POUND" spaces corresponding to the number of said tokens.

3. A board game as set forth in claim 1 which further comprises an inner path including a plurality of said spaces, an outer path including a plurality of said spaces and a single space connecting said paths to provide access between said paths.

4. A board game as set forth in claim 1 wherein said indicator is a die.

5. A board game as set forth in claim 1 wherein each token carries a representation of a cat.

6. A board game as set forth in claim 1 wherein said instructions for each space are selected from the group comprising:

picking one or more Hospital cards;

acquiring one or more animal parts;

losing a turn; and advancing to another space on the board.

7. A board game as set forth in claim 1 wherein each said token includes an upright pictorial representation of an animal fixed on a base.

8. A board game as set forth in claim 1 in which the animal parts are selected from the group consisting of an eye, an ear, a leg, a tail, a head and a body.

9. A board game as set forth in claim 8 in which each said "winner" card bears a winner instruction selected from the group comprising:

the player with the most complete animals wins the game;

the player with the most two eared animals wins the game;

the player with the most two legged animals wins the game;

the player with the highest score wins the game;

the player with the most three legged animals wins the game;

the player with the most one-eye animals wins the game; and the player with the most two-eye animals wins the game.

10. A board game as set forth in claim 2 wherein said board includes a plurality of "WARDEN/GO TO POUND" spaces.

* * * * *

UNITED STATES PATENT AND TRADEMARK OFFICE

CERTIFICATE OF CORRECTION

PATENT NO. : 4,824,117

DATED : April 25, 1989

INVENTOR(S) : John Russell

It is certified that error appears in the above-identified patent and that said Letters Patent is hereby corrected as shown below:

Column 4, line 12 "leg or" should be -3. leg or-

Column 4, line 30 "f" should be -of-

Column 5, line 10 "oh" should be -on-

Column 5, line 40 cancel "27"

Signed and Sealed this

Sixth Day of February, 1990

*Attest:*

JEFFREY M. SAMUELS

*Attesting Officer*

*Acting Commissioner of Patents and Trademarks*